US009315948B2

(12) United States Patent
Conte et al.

(10) Patent No.: US 9,315,948 B2
(45) Date of Patent: Apr. 19, 2016

(54) CABLE TRANSPORTATION SYSTEM FOR MOVING TRANSPORTATION UNITS ALONG A TRACK

(71) Applicant: ROLIC INTERNATIONAL S.AR.L, Luxembourg (LU)

(72) Inventors: Giuseppe Conte, Bolzano (IT); Franco Coco, Laives (IT)

(73) Assignee: ROPFIN B.V., Leimuiden (NL)

( * ) Notice: Subject to any disclaimer, the term of this patent is extended or adjusted under 35 U.S.C. 154(b) by 73 days.

(21) Appl. No.: 14/193,924

(22) Filed: Feb. 28, 2014

(65) Prior Publication Data

US 2014/0238260 A1 Aug. 28, 2014

(30) Foreign Application Priority Data

Feb. 28, 2013 (IT) ..... MI2013A0309

(51) Int. Cl.
*E01B 25/00* (2006.01)
*E01B 25/15* (2006.01)
*B61B 9/00* (2006.01)

(52) U.S. Cl.
CPC .. *E01B 25/15* (2013.01); *B61B 9/00* (2013.01)

(58) Field of Classification Search
CPC ..... E01B 7/00; E01B 7/02; E01B 7/10; E01B 7/18; E01B 7/20; E01B 25/00; E01B 25/14; E01B 25/15
USPC ..... 104/130.01, 130.02, 130.03, 130.06; 246/415 R, 416, 435 R
See application file for complete search history.

(56) References Cited

U.S. PATENT DOCUMENTS

| | | | | |
|---|---|---|---|---|
| 908,037 | A | 12/1908 | Robinson | |
| 4,109,584 | A * | 8/1978 | Mihirogi | 104/130.06 |
| 5,582,109 | A | 12/1996 | Levi et al. | |
| 8,302,536 | B1 * | 11/2012 | Meinzinger | 104/102 |
| 2010/0147183 | A1 * | 6/2010 | Weissbrodt | 104/307 |

FOREIGN PATENT DOCUMENTS

| | | |
|---|---|---|
| AT | 404010 | 7/1998 |
| AT | 405269 | 6/1999 |
| CH | 671929 | 10/1989 |
| EP | 0687607 | 12/1995 |
| EP | 1077167 | 2/2001 |

(Continued)

OTHER PUBLICATIONS

International Search Report and Written Opinion for International Application No. ITMI20130309 dated Nov. 1, 2013.

*Primary Examiner* — R. J. McCarry, Jr.
(74) *Attorney, Agent, or Firm* — Neal, Gerber & Eisenberg LLP

(57) ABSTRACT

A cable transportation system configured to move transportation units along a designated or given track has a switch with a first movable guide having one degree of freedom, along an operating plane, between two designated or given positions; a second movable guide having one degree of freedom, along the operating plane, between two designated or given positions; and a third and a fourth movable guide connected rigidly to each other and having one degree of freedom, along the operating plane, between two designated or given positions; the first, second, third and fourth movable guide being configured so that the first and second movable guide each define a continuation of the third or fourth movable guide.

10 Claims, 4 Drawing Sheets

(56) References Cited

FOREIGN PATENT DOCUMENTS

| | | |
|---|---|---|
| EP | 1088729 | 4/2001 |
| EP | 1088731 | 4/2001 |
| EP | 2407366 | 1/2012 |
| EP | 2441636 | 4/2012 |
| WO | WO 2008/129019 | 10/2008 |
| WO | WO 2009/019259 | 2/2009 |
| WO | WO 2009/053485 | 4/2009 |

* cited by examiner

CABLE TRANSPORTATION SYSTEM FOR MOVING TRANSPORTATION UNITS ALONG A TRACK

PRIORITY CLAIM

This application claims the benefit of and priority to Italian Patent Application No. MI2013A 000309, filed on Feb. 28, 2013, the entire contents of which is incorporated by reference herein.

BACKGROUND

Certain cable transportation systems which move vehicles along a given track are described in documents: Swiss Patent Document CH 671,929; Austrian Patent Document AT 404,010; U.S. Pat. No. 5,582,109; European Patent Document EP 687,607; Austrian Patent Document AT 405,269; European Patent Document EP 1,077,167; European Patent Document EP 1,088,729; Italian Patent Document IT 1,313,914; Italian Patent Document IT 1,317,169; Italian Patent Document IT 1,316,131; Italian Patent Document IT 1,326,531; PCT Patent Application Document WO 08/129,019; PCT Patent Application Document WO 2009/019,259; and PCT Patent Application Document WO 2009/053,485.

The tracks of certain of these cable transportation systems sometimes have at least one junction. One particular type of junction is where the track splits into two at a stop station for two vehicles travelling in opposite directions.

Cable transportation system tracks may comprise two-way and one-way sections, along which the transportation units pass one another in opposite directions.

Certain known cable transportation systems comprise two haul cables, which are operated in opposite directions, extend parallel to the track, between two opposite guides, and are connected to the transportation units by clamps integral with the units.

Certain known cable transportation systems therefore require switches, which, in addition to ensuring continuity of the track, must also avoid interfering with the haul cables and clamps.

One example of a known switch for cable transportation systems is described in Italian Patent Document IT 1,326,531, and comprises a track section defined by two curved, parallel rails extending along respective arcs of a circle and mounted on a pivot. The curved rails are designed to connect different branches of the track, depending on the angular position of the pivot. Though effective, this type of switch has the drawback of having a very large, extremely heavy moving part, such that switching tracks involves a good deal of travel and, therefore, time.

Other types of cable transportation system switches are described in European Patent Applications EP 2,407,366 and EP 2,441,636, in which at least one movable guide, with one degree of freedom along an operating plane, is moved between two given positions by an actuating system comprising a linear actuator.

The switch described in European Patent Application EP 2,407,366 has the advantage of being extremely simple and minimizing the moving mass, but does not allow for switching tracks along curves.

Conversely, the switch described in European Patent Application EP 2,441,636 has four movable guides for switching tracks along curves, but has a considerable moving mass that projects outwards of the track.

SUMMARY

The present disclosure relates to a cable transportation system configured to move transportation units along a designated or given track.

It is an advantage of the present disclosure to provide a cable transportation system configured to minimize certain of the drawbacks of certain of the known art.

According to the present disclosure, there is provided a cable transportation system configured to move transportation units along a designated or given track, the cable transportation system comprising a switch in turn comprising a first movable guide having one degree of freedom, along an operating plane, between two designated or given positions; a second movable guide having one degree of freedom, along the operating plane, between two designated or given positions; and a third and a fourth movable guide connected rigidly to each other and having one degree of freedom, along the operating plane, between two designated or given positions; the first, second, third and fourth movable guide being configured so that the first and second movable guide each define a continuation of the third or fourth movable guide.

In other words, the movable guides are complementary in pairs. Using this principle, connected cornering switches of any configuration can be formed, by making relatively small movements of relatively short movable guides.

In one embodiment, the system comprises an outer first and second fixed guide in the operating plane; the first, second, third and fourth movable guide being located between the first and second fixed guide.

It should be appreciated that in no configuration does the switch project outwards of the track. Accordingly, the cable transportation system disclosed herein is especially advantageous in tight track space situations.

In one embodiment, the first movable guide and the first fixed guide are configured to be positioned adjacent to each other in a first operating configuration.

The same also applies to the second movable guide: the second movable guide and the second fixed guide are configured to be positioned adjacent to each other in a second operating configuration.

This way, continuity of the track between fixed and movable guides is achieved.

In one embodiment, the first and second movable guide rotate respectively about a first and second axis, both perpendicular to the operating plane.

This makes the movable guides extremely easy to operate.

In one embodiment, the third and fourth movable guide rotate about a third axis perpendicular to the operating plane.

This simplifies operation of the third and fourth movable guide. The system also comprises a third and fourth fixed guide located between the first and second fixed guide and converging towards the third axis. This way, the third fixed guide and third movable guide can be configured to form a continuation of each other.

Likewise, the fourth fixed guide and fourth movable guide can be configured to form a continuation of each other.

In one embodiment, the system comprises an actuating assembly connected to the first and second movable guide to move the first and second movable guide between the respective designated or given positions.

One actuating assembly is thus capable of advantageously moving two movable guides.

In one embodiment, the actuating assembly comprises a rotary actuator; and a crank which rotates, about a fourth axis, between two limit stops, and is connected to the first and second movable guide to define a mechanism movable between two stable positions.

The stability of the mechanism positions eliminates the need for locking devices configured to lock the first and second movable guide in the respective operating configurations.

In one embodiment, the system comprises a further actuating assembly connected to the third and fourth movable guide to move the third and fourth movable guide between the respective designated or given positions.

In this case, too, the mechanism configuration ensures stability of the third and fourth movable guide operating configurations. More specifically, the further actuating assembly comprises a further rotary actuator; and a further crank which rotates, about a fifth axis, between two limit stops, and is connected to the third and fourth movable guide to define a mechanism movable between two stable positions.

Additional features and advantages are described in, and will be apparent from the following Detailed Description and the figures.

BRIEF DESCRIPTION OF THE DRAWINGS

A non-limiting embodiment of the present disclosure will be described by way of example with reference to the attached drawings, in which.

DETAILED DESCRIPTION

Figure 1:
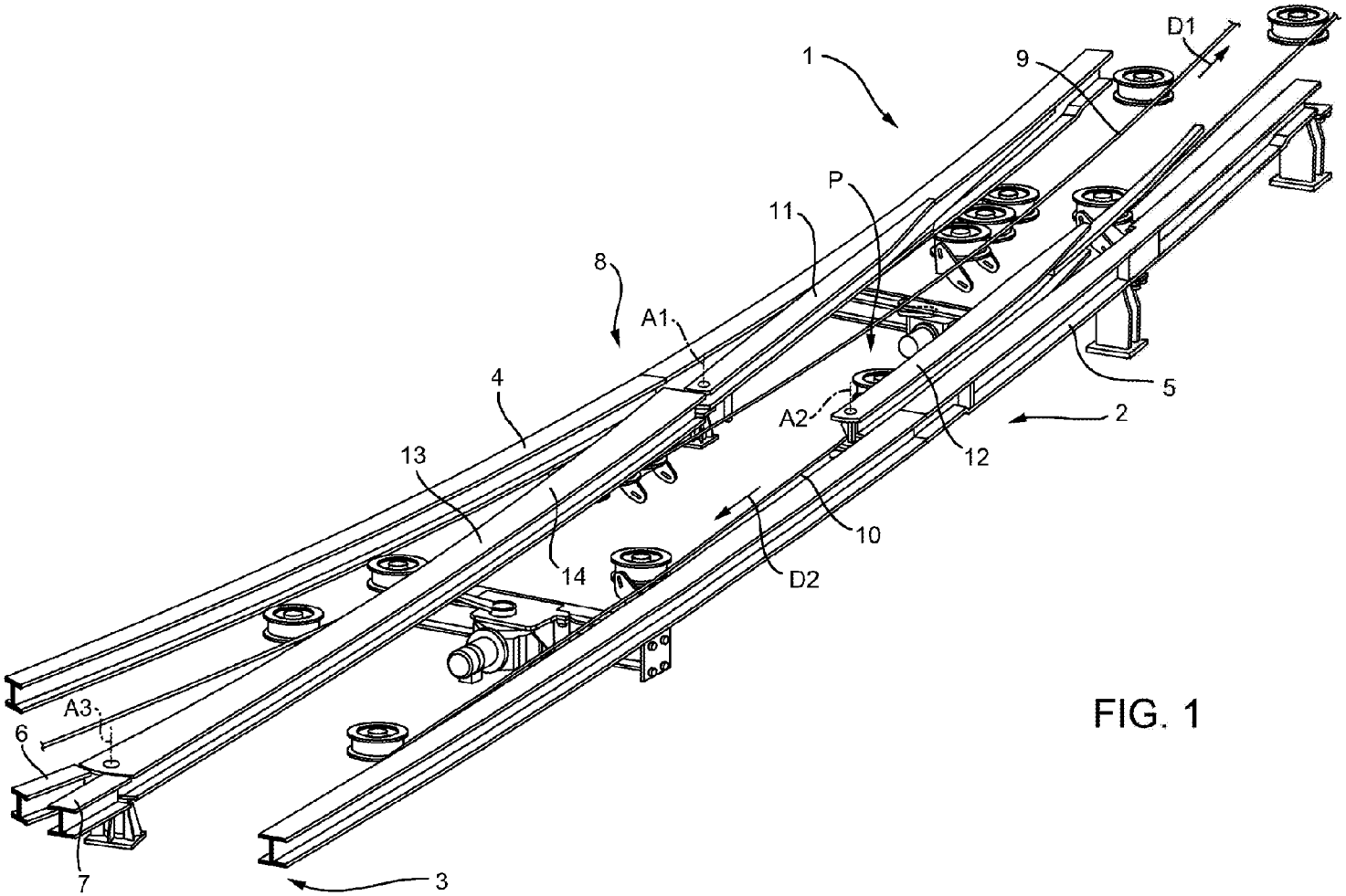
FIG. 1 shows a view in perspective, with parts removed for clarity, of a cable transportation system in accordance with the present disclosure and in a first operating position.

Referring now to the example embodiments of the present disclosure illustrated in FIGS. 1 to 6, number 1 in FIG. 1 indicates as a whole a cable transportation system configured to move transportation units (not shown in the attached drawings) along a track 2 comprising a junction 3. Track 2 is defined by outer fixed guides 4 and 5, by inner fixed guides 6 and 7, and by a switch 8 between outer fixed guides 4 and 5.

Cable transportation system 1 comprises two haul cables 9 and 10 moved in opposite directions D1 and D2; and the transportation units (not shown). In one such embodiment, the transportation units are attachable selectively to one of haul cables 9 and 10.

Switch 8 comprises a movable guide 11 having one degree of freedom, along the operating plane P, between two designated or given positions; a movable guide 12 having one degree of freedom, along the operating plane P, between two designated or given positions; and a third and fourth movable guide 13 and 14 connected rigidly to each other and having one degree of freedom, along the operating plane P, between two designated or given positions. More specifically, movable guides 11, 12, 13 and 14 are configured so that movable guides 11 and 12 each define a continuation of movable guide 13 or 14. In FIG. 1, movable guide 11 defines an ideal continuation of movable guide 14.

Figure 2:
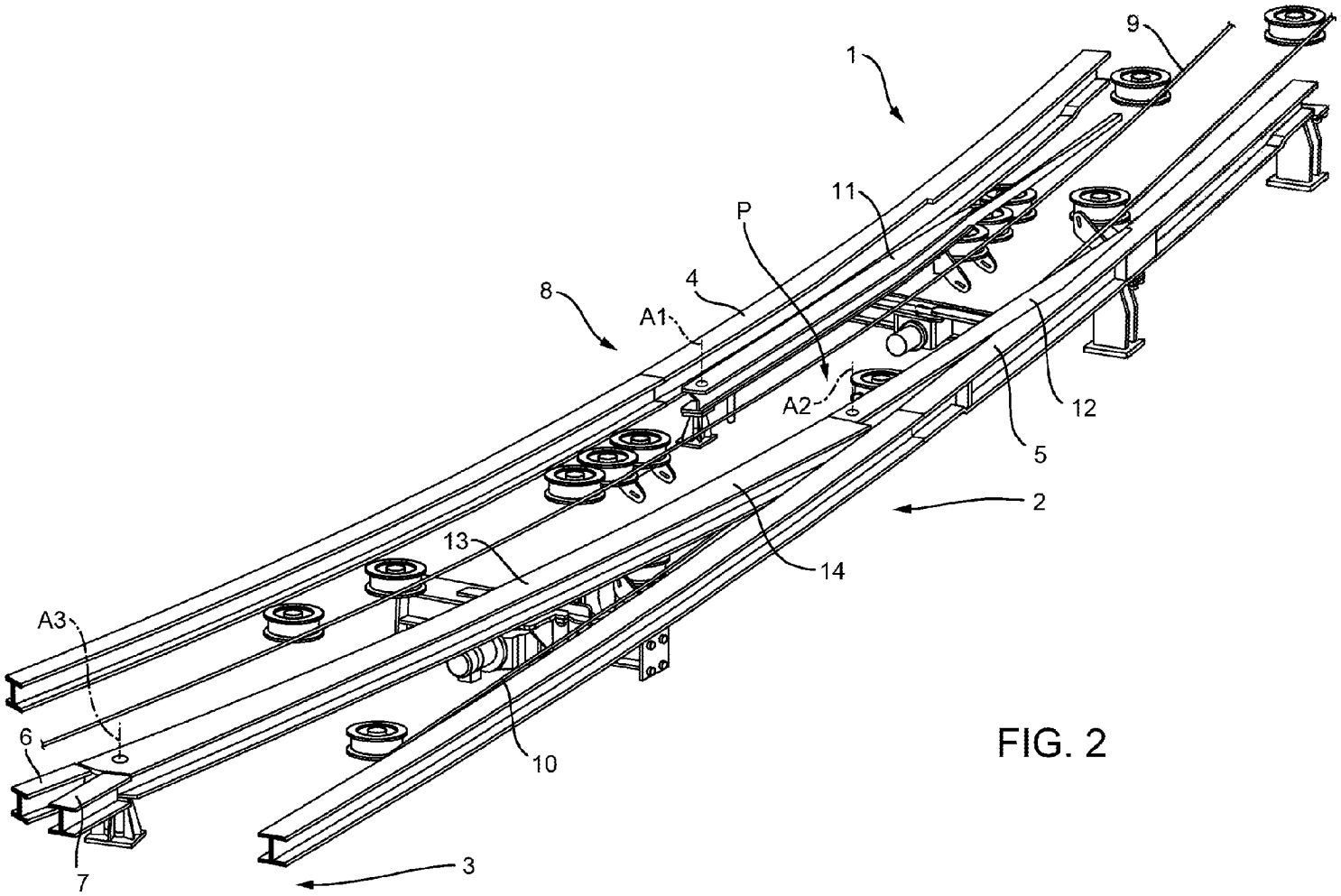
FIG. 2 shows a view in perspective, with parts removed for clarity, of the FIG. 1 system in a second operating position.

In FIG. 2, movable guide 12 defines an ideal continuation of movable guide 13.

In the FIG. 1 operating configuration, movable guide 11 has a free end adjacent to fixed guide 4. More specifically, fixed guide 4 and movable guide 11 are configured to form a shape fit.

Movable guide 11 is mounted to rotate about an axis A1 perpendicular to operating plane P with respect to a fixed structure. Movable guide 11 is hinged about axis A1 at the opposite end to its free end.

In the FIG. 2 operating configuration, movable guide 12 has a free end adjacent to fixed guide 5. More specifically, fixed guide 5 and movable guide 12 are configured to form a shape fit.

Movable guide 12 is mounted to rotate about an axis A2 perpendicular to operating plane P with respect to a fixed structure. Movable guide 12 is hinged about axis A2 at the opposite end to its free end.

As shown in FIGS. 1, 2, 3 and 5, movable guides 13 and 14 are mounted to rotate about an axis A3 perpendicular to operating plane P.

Figure 3:
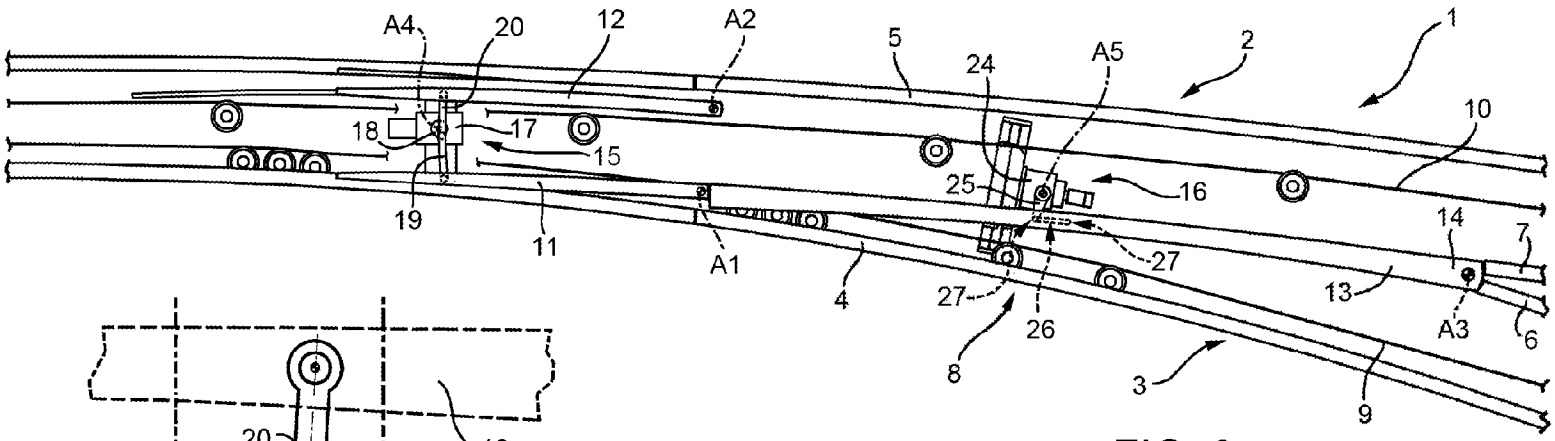
FIG. 3 shows a smaller-scale plan view, with parts removed for clarity, of the FIG. 1 system.

In the FIGS. 1 and 3 operating configuration, fixed guide 7 and movable guides 14 and 11 are aligned to define a section parallel to fixed guide 5.

Figure 5:
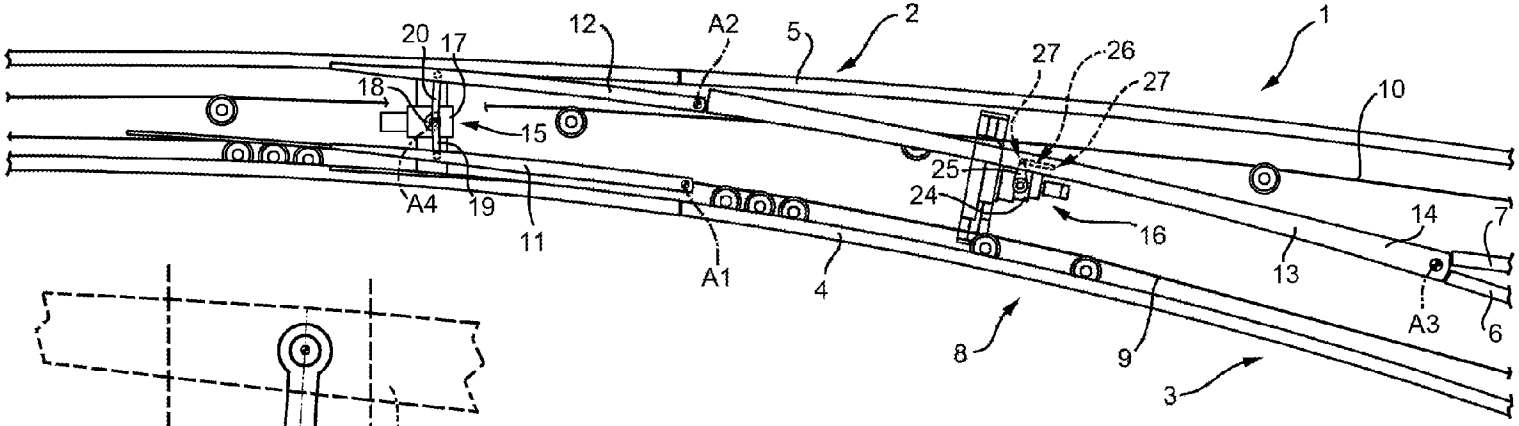
FIG. 5 shows a smaller-scale plan view, with parts removed for clarity, of the FIG. 2 system.

In the FIGS. 2 and 5 operating configuration, fixed guide 6 and movable guides 13 and 12 are aligned to define a section parallel to fixed guide 4.

In one embodiment, axes of rotation A1 and A2 are located along an arc of a circle centred around axis A3.

With reference to FIGS. 3 and 5, cable transportation system 1 comprises an actuating assembly 15 configured to move movable guides 11 and 12 between their respective designated or given positions.

Cable transportation system 1 comprises an actuating assembly 16 configured to move movable guides 13 and 14 into their designated or given positions.

Figure 4:
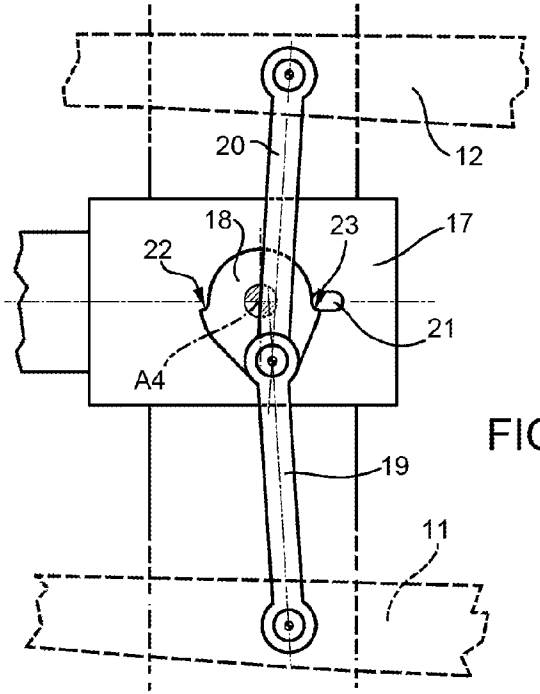
FIG. 4 shows a larger-scale plan view, with parts removed for clarity, of a detail of the FIG. 3 system.
Figure 6:
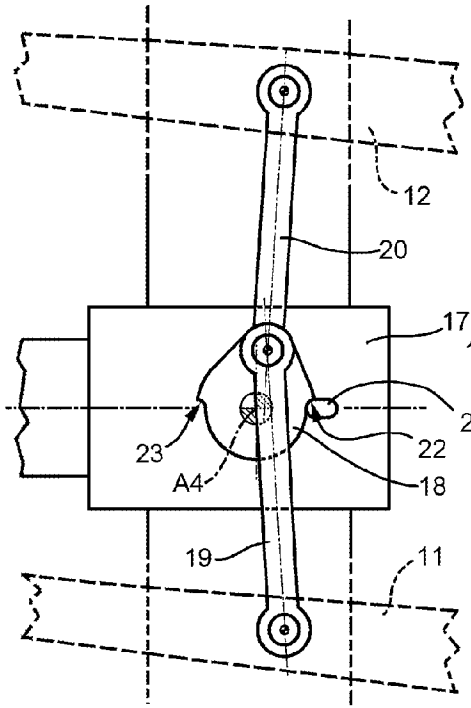
FIG. 6 shows a larger-scale plan view, with parts removed for clarity, of a detail of the FIG. 5 system.

As shown more clearly in FIGS. 4 and 6, actuating assembly 15 comprises a rotary actuator 17; and a crank 18, which is rotated about an axis A4, perpendicular to operating plane P, by rotary actuator 17.

Crank 18 is connected to both movable guides 11 and 12 by respective connecting rods 19 and 20, which are hinged at one end to crank 18, and at the other end to respective movable guides 11 and 12.

Crank 18, movable guides 11 and 12, and connecting rods 19 and 20 define a mechanism with one degree of freedom and controlled by rotary actuator 17.

The operating configurations of movable guide 11 and movable guide 12 correspond to two stable configurations of the mechanism, and to two limit stop positions of crank 18.

The term 'stable configuration' includes a configuration that is unaffected by external forces acting on movable guides 11 and 12. It should be appreciated that the force applied by crank 18 is not considered one external to the mechanism.

The stability of the mechanism is due to the limit stop positions of crank 18 being located slightly beyond the top dead centre position (FIG. 6) and bottom dead centre position (FIG. 4).

The opposite limit stops of crank 18 are defined by a fixed catch 21 engaged alternatively by latches 22 and 23 on crank 18.

With reference to FIGS. 3 and 5, actuating assembly 16 comprises a rotary actuator 24; and a crank 25, which is rotated about an axis A5, perpendicular to operating plane P, by rotary actuator 24.

Crank 25 is connected to movable guides 13 and 14 by a slot 26 engaged slidably by the free end of crank 25. Slot 26 extends between two opposite ends 27.

Crank 25, movable guides 13 and 14, and the connecting rods define a mechanism with one degree of freedom and controlled by rotary actuator 24.

The operating configurations of movable guides 13 and 14 correspond to two stable configurations of the mechanism, and to two limit stop positions of crank 25.

The term 'stable configuration' includes a configuration that is unaffected by external forces acting on movable guides 13 and 14. It should be appreciated that the force applied by crank 25 is not considered one external to the mechanism.

The stability of the mechanism is due to the limit stop positions of crank 25 being located slightly beyond the top dead centre position (FIG. 5) and bottom dead centre position (FIG. 3).

The opposite limit stops of crank 25 are defined by the crank engaging one end 27 of slot 26.

The present disclosure makes it possible to form different types of mechanisms, and to operate a quantity or number of movable guides using one actuating assembly capable of assuming two stable positions.

Clearly, changes may be made to the switch described without, however, departing from the scope of the accompanying Claims. That is, various changes and modifications to the presently disclosed embodiments will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A cable transportation system configured to move transportation units along a designated track, the cable transportation system comprising:

a switch including:

a first movable guide configured to move along an operating plane, from a first designated position to a second designated position and from the second designated position to the first designated position, a second movable guide configured to move along the operating plane, from a third designated position to a fourth designated position and from the fourth designated position to the third designated position, a third movable guide, a fourth movable guide rigidly connected to the third movable guide, said third and fourth movable guides configured to move along the operating plane, from a fifth designated position to a sixth designated position and from the sixth designated position to the fifth designated position, wherein the first movable guide, the second movable guide, the third movable guide and the fourth movable guide are configured such that the first movable guide and the second movable guide alternatively define a continuation of at least one of the third moveable guide and the fourth movable guide, a first actuating assembly connected to the first movable guide and the second movable guide and configured to move the first movable guide and the second movable guide, said first actuating assembly including:

a first rotary actuator, and a first crank which pivots, about a first axis, from a first limit stop position to a second limit stop position and from the second limit stop position to the first limit stop position and which is connected to the first movable guide and the second movable guide to define a first mechanism configured to be moved from a first stable position to a second stable position and from the second stable position to the first stable position, and a second actuating assembly connected to the third movable guide and the fourth movable guide and configured to move the third movable guide and the fourth movable guide, said second actuating assembly including:

a second rotary actuator, and a second crank which pivots, about a second axis, from a third limit stop position to a fourth limit stop position and from the fourth limit stop position to the third limit stop position and which is connected to the third movable guide and the fourth movable guide to define a second mechanism configured to be moved from a third stable position to a fourth stable position and from the fourth stable position to the third stable position.

2. The cable transportation system of claim 1, which includes a first outer fixed guide and a second outer fixed guide, wherein the first movable guide, the second movable guide, the third movable and the fourth movable guide are each located between the first outer fixed guide and the second outer fixed guide.

3. The cable transportation system of claim 2, wherein the first movable guide and the first outer fixed guide are configured to be positioned adjacent to each other in a first operating configuration.

4. The cable transportation system of claim 3, wherein the second movable guide and the second outer fixed guide are configured to be positioned adjacent to each other in a second operating configuration.

5. The cable transportation system of claim 1, wherein the first movable guide is configured to pivot about a first axis transverse to the operating plane and the second movable guide is configured to pivot about a second axis transverse to the operating plane.

6. The cable transportation system of claim 1, wherein the third movable guide and the fourth movable guide are configured to pivot about a third axis transverse to the operating plane.

7. The cable transportation system of claim 6, wherein the switch includes a third fixed guide and a fourth fixed guide located between the first outer fixed guide and the second outer fixed guide, said third fixed guide and said fourth fixed guide converge towards the third axis.

8. The cable transportation system of claim 7, wherein the third movable guide is configured to define a continuation of the third fixed guide.

9. The cable transportation system of claim 7, wherein the fourth movable guide is configured to define a continuation of the fourth fixed guide.

10. A cable transportation system switch comprising:

a first movable guide configured to move along an operating plane, from a first designated position to a second designated position and from the second designated position to the first designated position;

a second movable guide configured to move along the operating plane, from a third designated position to a fourth designated position and from the fourth designated position to the third designated position;

a third movable guide; and a fourth movable guide rigidly connected to the third movable guide, said third and fourth movable guides configured to move along the operating plane, from a fifth designated position to a sixth designated position and from the sixth designated position to the fifth designated position, wherein the first movable guide, the second movable guide, the third movable guide and the fourth movable guide are configured such that the first movable guide and the second movable guide alternatively define a continuation of at least one of the third moveable guide and the fourth movable guide, a first actuating assembly connected to the first movable guide and the second movable guide and configured to move the first movable guide and the second movable guide, said first actuating assembly including:

a first rotary actuator, and a first crank which pivots, about a first axis, from a first limit stop position to a second limit stop position and from the second limit stop position to the first limit stop position and which is connected to the first movable guide and the second movable guide to define a first mechanism configured to be moved from a first stable position to a second stable position and from the second stable position to the first stable position, and a second actuating assembly connected to the third movable guide and the fourth movable guide and configured to move the third movable guide and the fourth movable guide, said second actuating assembly including:

a second rotary actuator, and a second crank which pivots, about a second axis, from a third limit stop position to a fourth limit stop position and from the fourth limit stop position to the third limit stop position and which is connected to the third movable guide and the fourth movable guide to define a second mechanism configured to be moved from a third stable position to a fourth stable position and from the fourth stable position to the third stable position.

* * * * *